US006035845A

United States Patent [19]

Käser

[11] Patent Number: 6,035,845

[45] Date of Patent: Mar. 14, 2000

[54] SAW STRIP FOR FIXING A CRYSTAL AND PROCESS FOR CUTTING OFF WAFERS

[75] Inventor: Maximilian Käser, Burghausen, Germany

[73] Assignee: Wacker Siltronic Gesellschaft für Halbleitermaterialien AG, Burghausen, Germany

[21] Appl. No.: 09/135,868

[22] Filed: Aug. 18, 1998

[30] Foreign Application Priority Data

Sep. 11, 1997 [DE] Germany ..... 197 39 965

[51] Int. Cl.[7] ..... B28D 1/08

[52] U.S. Cl. ..... 125/16.02; 83/651.1; 83/14; 125/21

[58] Field of Search ..... 83/651.1, 14; 125/16.02, 125/21, 35, 12; 269/286, 903

[56] References Cited

U.S. PATENT DOCUMENTS

| | | | |
|---|---|---|---|
| 4,655,191 | 4/1987 | Wells et al. | 125/21 X |
| 4,834,062 | 5/1989 | Frank et al. . | |
| 5,377,568 | 1/1995 | Hauser . | |
| 5,875,769 | 3/1999 | Toyama et al. | 125/16.02 |
| 5,875,770 | 3/1999 | Fukunaga | 125/21 X |
| 5,893,308 | 4/1999 | Katamachi et al. | 83/13 |
| 5,904,136 | 5/1999 | Nagatsuka et al. | 125/16.02 |

FOREIGN PATENT DOCUMENTS

| | | |
|---|---|---|
| 0232920 | 8/1987 | European Pat. Off. . |
| 0348783 | 1/1990 | European Pat. Off. . |
| 0552663 | 7/1993 | European Pat. Off. . |
| 9019921 | 1/1997 | Japan . |

OTHER PUBLICATIONS

Patent Abstracts of Japan, vol. 097, No. 005, May 30, 1997, & JP 9–019921, Jan. 21, 1997.

*Primary Examiner*—M. Rachuba
*Assistant Examiner*—T. Anthony Vaughn
*Attorney, Agent, or Firm*—Collard & Roe, P.C.

[57] ABSTRACT

A saw strip for fixing a crystal of semiconductor material when cutting wafers from this crystal using a wire saw, and a method for cutting wafers using the saw strip. The strip has a section adjoining the crystal that has a hardness which essentially corresponds to the hardness of the crystal. The saw strip may be a composite of several sections and/or may have a hollow cross section.

7 Claims, 1 Drawing Sheet

SAW STRIP FOR FIXING A CRYSTAL AND PROCESS FOR CUTTING OFF WAFERS

BACKGROUND OF THE INVENTION

1. Field of the Invention

The invention relates to a saw strip for fixing a crystal of semiconductor material when cutting wafers from this crystal using a wire saw. The invention also relates to a process for cutting off wafers using the saw strip is used.

2. The Prior Art

When cutting wafers from a crystal of semiconductor material using a wire saw, undesirable flutes or saw marks may be formed on the sides of the wafers following transverse deviations of the saw wire. The crystal is fixed on a saw strip into which the saw wire penetrates to a depth of a few millimeters after the wafers have been cut off. The saw strip usually consists of a solid graphite block, and the crystal is cemented onto this block using, for example, an epoxy resin adhesive.

SUMMARY OF THE INVENTION

It is an object of the invention to provide a saw strip that reliably avoids the formation of flutes when cutting wafers from a crystal of semiconductor material using a wire saw.

This object is achieved by a saw strip for fixing a crystal of semiconductor material when cutting wafers from this crystal using a wire saw. The strip has a section that adjoins the crystal and has a hardness that essentially corresponds to the hardness of the crystal.

Tests have established that the formation of flutes is closely related to the use of solid saw strips made of graphite. In comparison with semiconductor material, such as for example silicon, graphite is a relatively soft material. When cutting off the wafers, the saw wire has to overcome a certain resistance in the direction of advance. When the saw wire enters a saw strip made of graphite, this resistance suddenly becomes weaker. As a result, the saw wire may be deflected transversely, leaving behind flutes in the edge region of the wafers.

In order to prevent this, the present invention proposes a saw strip made from a material having a hardness that corresponds to the hardness of the semiconductor material, or has an approximately equal hardness. Saw strips made of a material having a hardness in the range of 4 to 7 on the Mohs scale, such as saw strips made of glass or silicon, have proven particularly suitable. It is also advantageous if the material used is an electrical insulator. In this case, the saw wire may be subjected to a weak electric current during the cutting operation and a crack in the wire or a ground contact can be detected by the resulting change in current intensity.

BRIEF DESCRIPTION OF THE DRAWINGS

The invention is explained below with reference to figures which diagrammatically show preferred embodiments of the saw strip, in cross-section. The drawings are for illustration only and do not define the limits of the invention.

In the drawings, wherein similar reference numbers denote similar elements throughout the several views.

DETAILED DESCRIPTION OF THE PREFERRED EMBODIMENTS

Figure 1:
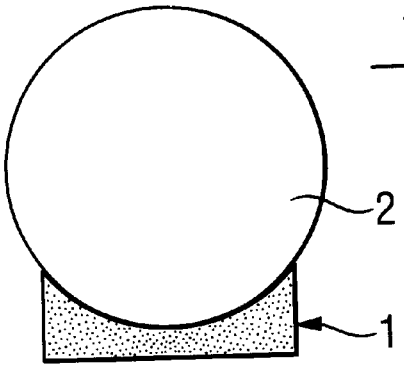
FIG. 1 shows a solid saw strip according to the invention.

Turning now in detail to the drawings and in particular, FIG. 1, there is shown a saw strip 1 underneath a crystal 2.

Saw strip 1 is made from a material whose hardness essentially coincides with the hardness of the semiconductor material from which crystal 2 is made. Due to this material selection, the saw wire remains in the planned cutting plane even when it enters the saw strip, so that the edges of the wafers are not damaged.

Figure 2:
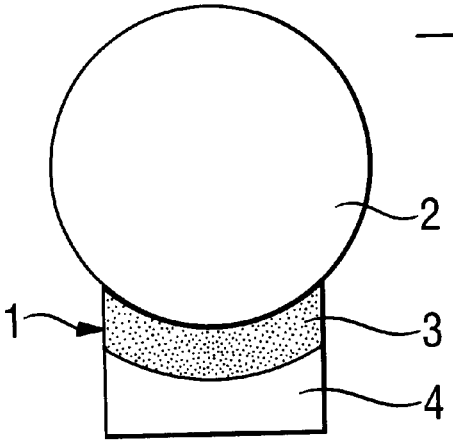
FIG. 2 shows a saw strip according to the invention designed as a layered body.

In the embodiment shown in FIG. 2, saw strip 1 consists of a layered, structured composite body. Section 3, which adjoins the crystal, consists of a material whose hardness is equal or similar to the hardness of crystal 2. Section 3 preferably consists of a glass or silicon shell that is matched to the shape of the crystal, if the crystal consists of silicon. This shell is adjoined by at least one further section 4 which is made of a material that is significantly softer than the material of section 3. It is particularly preferable for section 4 to consist of graphite or to have a similar hardness to that of graphite. The sections of the layered, structured composite body are preferably adhesively bonded to one another. Using a saw strip of this nature avoids the formation of flutes. It is also particularly simple to break the cut wafers from the saw strip, because after the wafers have been cut off, the join to the saw strip which remains and is formed by a section of the saw strip is comparatively soft and is suitable as a desired breaking position.

Figure 3:
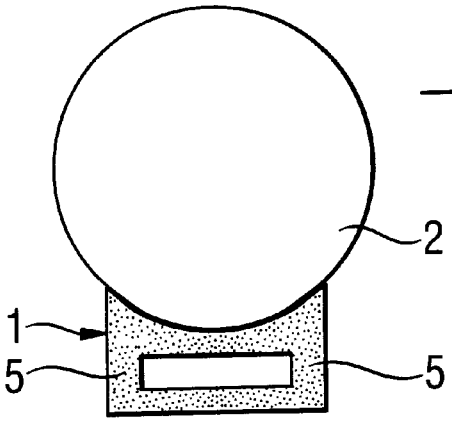
FIG. 3 shows a saw strip according to the invention having a hollow cross-section.

In accordance with the embodiment illustrated in FIG. 3, saw strip 1 is designed in cross section as a hollow section. The hollow section may be of any desired shape, for example rectangular, circular or polygonal in some other shape. After the wafers have been cut off, the hollow section provides that a comparatively narrow web 5, by which the wafers remain joined to the saw strip, remains behind. By breaking this join, the wafers can be freed. As a result, it is possible to avoid the need to return the saw wire along the cut produced when cutting off the wafers, thus avoiding damage to the wafers.

If a solid saw strip is used, the join to the saw strip which remains after the wafers have been cut off is comparatively wide, so that it is not possible to prevent a wafer from being damaged when the join is broken. By contrast, a remaining web which is narrow due to the hollow section is particularly suitable as a desired breaking position.

The invention also relates to a saw strip which is designed, in accordance with FIG. 2, as a composite body and which also has a hollow section in accordance with FIG. 3.

Thus, while only a few embodiments have been shown and described, it is obvious that many modifications may be made thereunto without departing from the spirit and scope of the invention.

What is claimed is:

1. A saw strip for fixing a crystal of semiconductor material to be cut into wafers by a wire saw, said crystal having a hardness and said saw strip being comprised of a composite body which is structured in sections, said saw strip comprising:

a section adjoining the crystal and having a hardness which is approximately equal to the hardness of the crystal; and a section having a hardness substantially lower than the hardness of the section adjoining the crystal and being situated at a distance further away from the crystal than the section ajoining the crystal.

2. The saw strip as claimed in claim 1, wherein the section adjoining the crystal consists of a material selected from the group consisting of glass and silicon.

3. The saw strip as claimed in claim 1, wherein the saw strip has a hollow cross section.

4. A process for cutting wafers from a crystal having a hardness using a wire saw, comprising:

fixing the crystal on a saw strip comprised of a composite body that is structured in sections;

cutting into the crystal with the wire saw;

cutting into a section of the saw strip adjoining the crystal, said section having a hardness approximately equal to the hardness of the crystal; and cutting into a section of the saw strip having a hardness that is substantially lower than the hardness of the section adjoining the crystal.

5. The method according to claim 4, wherein the saw strip is made from a material selected from the group consisting of glass and silicon.

6. The method according to claim 4, wherein the saw strip has a hollow cross section.

7. A process for cutting wafers from a crystal using a wire saw, said crystal having a hardness, comprising:

fixing the crystal on a saw strip comprised of a section adjoining the crystal and a section having a closed hollow cross section, the section adjoining the crystal having a hardness approximately equal to the hardness of the crystal;

cutting into the crystal with the wire saw to form the wafers;

cutting into the section of the saw strip adjoining the crystal;

cutting into the section having the closed hollow cross section; and breaking a join between the wafers and the saw strip without returning the saw wire along the cut produced.

* * * * *